US006233764B1

(12) United States Patent
Orr

(10) Patent No.: US 6,233,764 B1
(45) Date of Patent: May 22, 2001

(54) BED ASSEMBLIES

(75) Inventor: Cathy K. Orr, Laguna Hills, CA (US)

(73) Assignee: Zephtex Industries Incorporated, Dana Point, CA (US)

( * ) Notice: Subject to any disclaimer, the term of this patent is extended or adjusted under 35 U.S.C. 154(b) by 0 days.

(21) Appl. No.: 09/255,152

(22) Filed: Feb. 22, 1999

(51) Int. Cl.[7] ..... A47G 9/04
(52) U.S. Cl. ..... 5/496; 5/692; 5/498
(58) Field of Search ..... 5/692, 494, 496, 5/498, 499, 501

(56) References Cited

U.S. PATENT DOCUMENTS 364,797 * 6/1887 Brooks ..... 5/499 X
2,630,587 * 3/1953 Brown ..... 5/496
3,083,378 * 4/1963 Pursell ..... 5/498
3,179,958 * 4/1965 Carris ..... 5/692 X
6,009,579 * 1/2000 Pederson ..... 5/499 X

* cited by examiner

*Primary Examiner*—Michael F. Trettel
(74) *Attorney, Agent, or Firm*—Robert D. Fish; Fish & Associates, LLP

(57) ABSTRACT

An improved bed assembly having a sheet with multiple fasteners of at least two different types for attaching the sheet to a bed. The sheet may be combined with a mattress having fasteners suitable for coupling with at least some of the sheet fasteners. The sheet may include fasteners which are of a type not found on the mattress, and the mattress may include fasteners which are of a type not found on the sheet.

10 Claims, 2 Drawing Sheets

FIG. 1
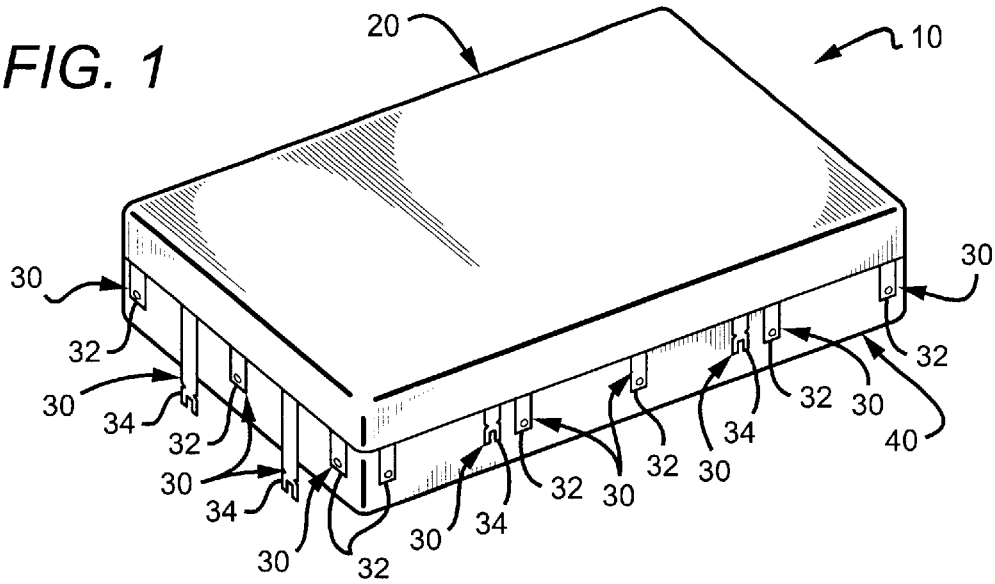
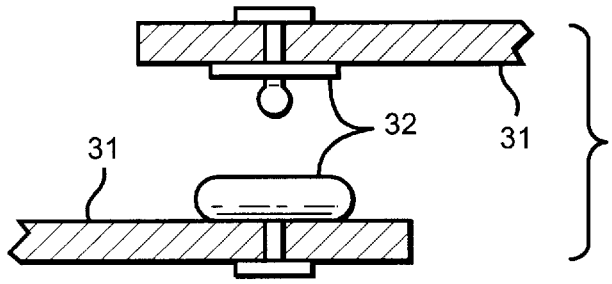
FIG. 2
FIG. 3
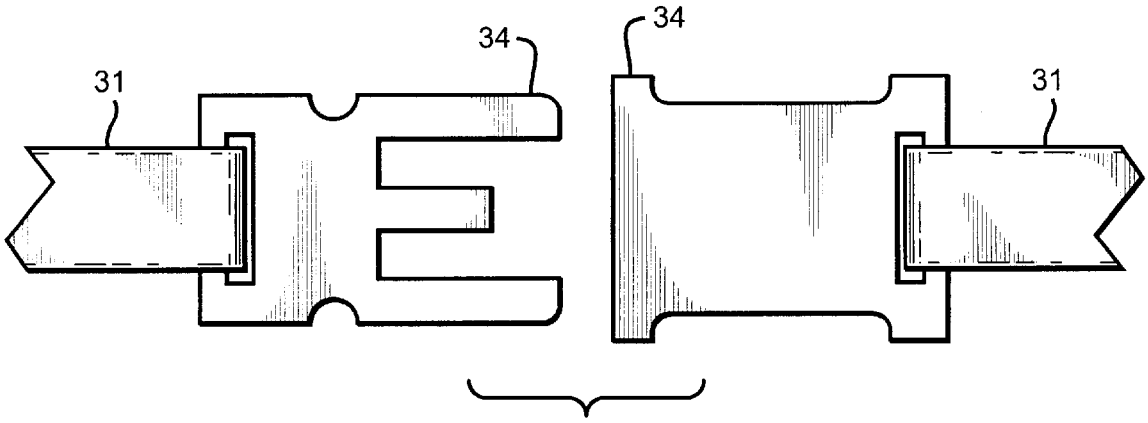

FIG. 4
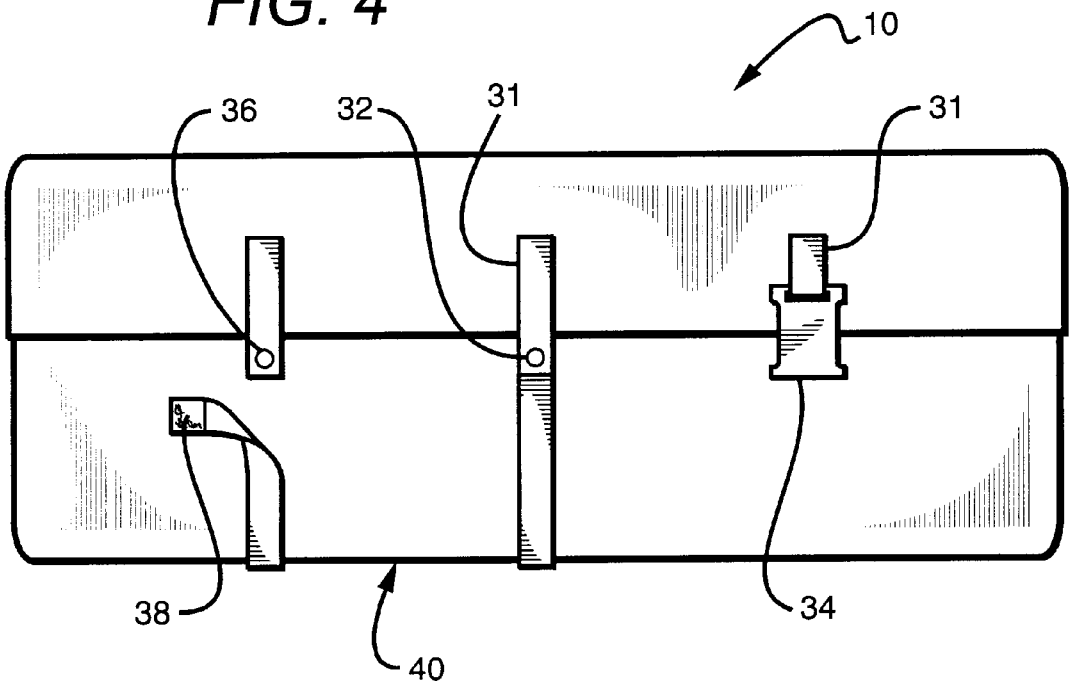
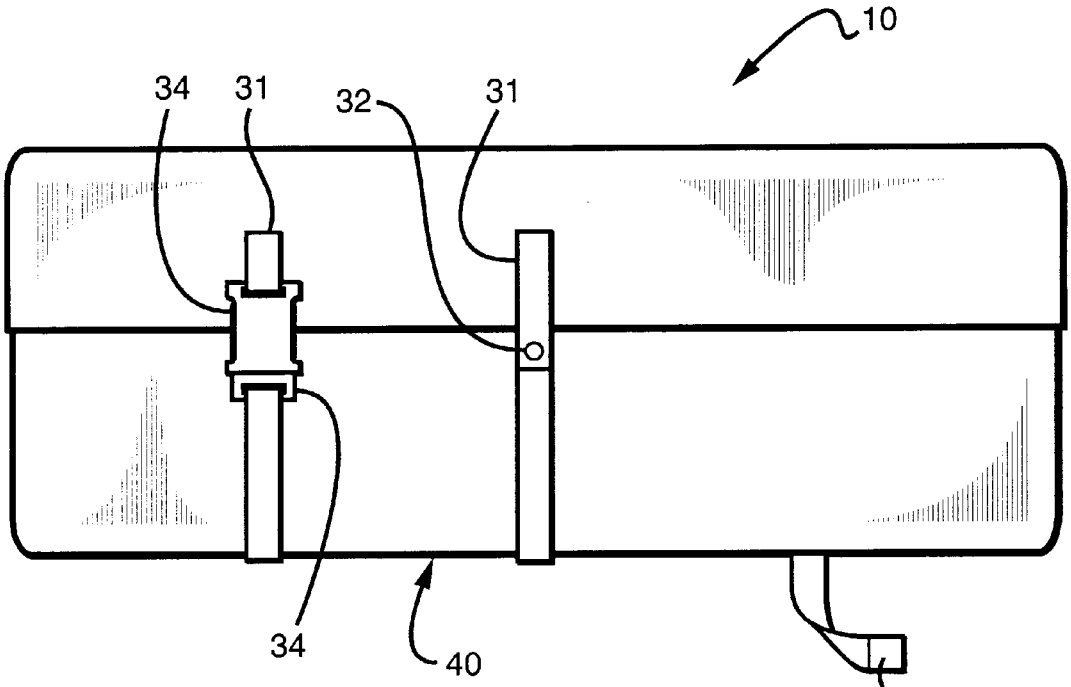
FIG. 5

BED ASSEMBLIES

FIELD OF THE INVENTION

The field of the invention is bed linens.

BACKGROUND OF THE INVENTION

Sheets that are not attached in some way to a mattress tend to dislocate. To prevent dislocation, attachable sheets have been developed. Such sheets can generally be divided into two classes depending on whether their use requires modification of the bed on which they are used, possibly by modifying the mattress, bed frame and/or spring box.

The first class includes sheets having fastening members which will operate correctly without modifying the bed and, when removed from the bed, leave no fastening members or portions thereof on the bed. For example, U.S. Pat. No. 5,628,077 to Brigenti discloses the use of drawstrings, U.S. Pat. No. 5,815,861 to Lairange et al. shows T-type or spider net-type elastic fasteners spanning across the bottom of the mattress, and in U.S. Pat. No. 5,179,743 to Lanman, long elastic straps diagonally extending across the bottom of the mattress are used. Another example is U.S. Pat. No. 4,937, 904 to Ross wherein elastic bands, slideably connected through openings in the sheet, are used to help prevent dislocation of the sheet. Sheets from this class generally cooperate well with many different mattresses, but their use tends to be problematic in that they generally require the mattress to be turned over or otherwise moved for installation and/or adjustment of the sheet fasteners.

The second class includes sheets having fasteners that will not operate correctly without modifying the bed, and when removed from the bed, leave a fastening member or portion thereof on the bed. Such fasteners generally comprise at least two portions that can be coupled together. One portion is connected to the bed, the other to the sheet, and the two portions are coupled together when the sheet is placed on the bed and uncoupled when the sheet is removed from the bed. Examples of such fasteners include buckles, zippers, snaps or hook and loop type fasteners. As used herein, a "fastener" is often an assembly of elements such as a buckle with a pair or elastic or adjustable straps with one strap permanently connected to the side of the mattress, and the other strap permanently connected to the sheet. Another example is found in U.S. Pat. No. 4,698,880 to Hamm, in which a wedge connected to the bed frame contacts the sheet and an additional element holds the wedge and sheet together in a fixed position.

Sheets in the second class can generally be put on and taken off of a bed with little or no movement of the mattress. However, their use requires modification of the mattress by attaching a portion of each of the sheet fasteners to the bed. If one purchases a mattress having permanently installed fastener elements, one's choice in purchasing sheets is limited to those choices which have fastener elements of the same type as found on the mattress. Moreover, in facilities having a large number of beds such as a hospital, using attachable sheets becomes more burdensome if different beds have different types of fasteners (even if not permanently installed) because of the need to match particular sheets to particular beds. Although one could utilize a standard fastener type on all beds, doing so tends to be costly as choices for new or replacement beds is limited by fastener type, and switching to a new fastener type requires modifying every bed in the facility.

As the use of known attachable sheets tends to be problematic, there is a continuing need to develop improved bed assemblies which include attachable sheets.

SUMMARY OF THE INVENTION

An improved bed assembly having a sheet with multiple fasteners of at least two different types for attaching the sheet to a bed. The sheet may be combined with a mattress having fasteners suitable for coupling with at least some of the sheet fasteners. The sheet may include fasteners which are of a type not found on the mattress, and the mattress may include fasteners which are of a type not found on the sheet.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1 is a perspective view of an improved sheet assembly embodying the invention.

FIG. 2 is a perspective view of a preferred fastening member.

FIG. 3 is a persective view of a preferred fastening member.

FIG. 4 is a side view of a preferred sheet assembly.

FIG. 5 is a side view of a preferred sheet assembly.

DETAILED DESCRIPTION

In FIG. 1, bed/sheet assembly 10 is connected to mattress 40 by at least one of the fastening members 30. Sheet assembly 10 has a cover portion 20 and a plurality of fastening members 30. The fastening members 30 include at least 2 different types of fasteners 32 and 34 (See FIGS. 2 and 3) and fastening belts 31. It is contemplated that providing an attachable sheet with multiple types of fasteners will allow such a sheet to be utilized on a larger variety of beds and with less dependence on the types of fasteners used on the beds.

Cover portion 20 of sheet assembly 10 is preferably a padded nylon sheet of blue color, covering the horizontal upper surface and a portion of the sides of a mattress. In alternative embodiments cover portion 20 may be formed from one or more elements, may have various sizes and dimensions, and may be made in reasonable manner from any reasonable material or combination of materials. In particular, materials used in cover portion 20 may but do not necessarily include natural and synthetic fibers, woven and non-woven fabrics, and mixtures thereof such as cotton, polyester-cotton mixtures, silk, and wool. Similarly, size of cover portion 20 may vary with some embodiments being sized to cover only the top horizontal surface of a mattress or to cover the top horizontal surface and only 2 sides of a mattress.

The functionality of cover portion 20 may vary between embodiments. Thus, in some embodiments cover portion 20 may provide improved hygiene, comfort, or esthetics. It is contemplated that the composition of cover portion 20 will vary depending on the desired functionality. For example, the cover portion may be made from autoclavable or sterilizable material, may be filled or padded, or the cover portion may have a variety of colors or prints to be esthetically more pleasing. It is also contemplated that the composition of cover portion 20 may be modified by adding additional elements such as heater elements or name tags.

In preferred embodiments, fastening members 30 comprise elastic band fastener supports 31, a plurality of snaps 32 and clips 34 circumferentially sewn to the edge of the cover portion 20. In alternative embodiments, fastening members 30 may comprise more than two different types of fasteners. Such fasteners may be attached to the cover portion in many ways, including glued, tacked, riveted, etc. In other alternative embodiments the fastening member may be located only on one side of the cover portion, or on opposite sides of the cover portion.

Referring to FIGS. 2 and 3, preferred fastening members 30 comprise an elastic band fastener support 31, 2" long and ½" wide carrying a fastener which is the top portion of a press button/snap 32 or the male or female portion of a clip 34. In alternative embodiments, fastener support 31 may comprise a cotton band, plastic band or any other appropriate material capable of holding a top or bottom portion of a push button or the male or female portion of a clip. In some embodiments, the fastener (i.e. the press buttons or clips) may be replaced by zippers, hook and loop fasteners, or other types of fasteners. Fastening members 30 may be sized and dimensioned in any reasonable manner so long as they function to attach the sheet to a corresponding bed mounted fastening member.

It is contemplated that some embodiments of the improved bed assembly disclosed herein will comprise a combination of a attachable sheet assembly 10 and a mattress 40 with both the mattress and sheet each having a plurality of fastening members for fastening the sheet assembly 10 to the mattress 40. Such mattress and sheet assemblies may have any type of fasteners including buttons, snaps, clips, zippers and hook and loop fasteners. It is contemplated that at least some of the fastening members on the mattress will have a fastener which corresponds to the fastener on at least some of the fasteners on the sheet assembly. In some embodiments, mattress 40 and/or sheet assembly 10 may include fastening members which comprise a fastener type which does not correspond to a fastener type found on the sheet or mattress. Thus a given combination may have a mattress with snap/button and zipper type fasteners and a sheet with snap/button and clip type fasteners. In a preferred embodiment, mattress 40 is an inflatable air mattress carrying fastener members each of which has a fastener which is the top or bottom part of a push button. However, mattress may be any other type of mattress including, but not limited to latex, foam-filled, or water mattresses.

Referring to FIGS. 4–5, in some embodiments, sheet assembly 10 and mattress 40 may each have fasteners on their respective fastening members, but the mattress 40 may have more or less fastener types in use than sheet assembly 10, and sheet assembly 10 may have more or less fastener types in use than mattress 40. For example, FIG. 4 shows a sheet and mattress combination where sheet assembly 10 has fastening members with button 36, snap 32, and clip 34 fasteners, and mattress 40 has fastening members with Velcro™ 38, and snap 32 fasteners. In FIG. 5, sheet assembly 10 has fastening members with snap 32 and clip 34 fasteners, and mattress 40 has fastening members with Velcro™ 38, snap 32, and clip 34 fasteners. In embodiments where mattress 40 and sheet assembly 10 have at least two matching fastener types, one or more of the types may be used to fasten sheet assembly 10 to mattress 40.

Thus, specific embodiments and applications of improved bed assemblies have been disclosed. It should be apparent, however, to those skilled in the art that many more modifications besides those already described are possible without departing from the inventive concepts herein. The inventive subject matter, therefore, is not to be restricted except in the spirit of the appended claims.

What is claimed is:

1. A bed assembly comprising:

a cover portion;

at least one fastening member coupled to the cover portion, the at least one fastening member having a plurality of fasteners of at least two different types; and a mattress, the mattress consisting of at least one fastening member having at least one fastener which is the same type as at least one fastener of the plurality of fasteners of the at least one fastening member of the cover portion, wherein the mattress can be directly coupled to the cover portion through the at least one fastening member.

2. The bed assembly of claim 1 wherein each of the at least one fastening member has a single fastener.

3. The bed assembly of claim 1 comprising at least a first fastening member and a second fastening member with the first fastening member having a fastener of a type not found on the second fastening member.

4. The bed assembly of claim 1 wherein the at least one fastening member comprise a fastener support having a length within the range of 2" to 12".

5. The bed assembly of claim 1 wherein each of the plurality of fasteners is selected from the group comprising buckles, snaps, zippers, hook and loop fasteners.

6. The bed assembly of claim 1 wherein the at least two different types include buckles and snaps.

7. The bed assembly of claim 2 wherein each of the plurality of fasteners is selected from the group comprising buckles, snaps, zippers, hook and loop fasteners.

8. The bed assembly of claim 2 wherein the at least two different types include buckles and snaps.

9. The bed assembly of claim 8 wherein the at least one fastening member comprises at least one fastener which is not the same type as at least one fastener of the plurlaity of fasteners of the at least one fastening member of the cover portion.

10. The bed assembly of claim 2 wherein the at least one fastening member is/are detachably coupled to the cover portion.

* * * * *